US006117491A

United States Patent [19]

Rutanen et al.

[11] Patent Number: 6,117,491

[45] Date of Patent: Sep. 12, 2000

[54] PROCESS AND COATING COLOR FOR COATING OF PAPER AND BOARD

[75] Inventors: Anne Rutanen, Tikkakoski; Petri Silenius, Lohja as.; Jyrki Kettunen, Kirkniemi, all of Finland

[73] Assignee: Metsa-Serlä Oy, Finland

[21] Appl. No.: 09/006,656

[22] Filed: Jan. 13, 1998

[30] Foreign Application Priority Data

Jan. 13, 1997 [FI] Finland ..... 970133

[51] Int. Cl.[7] ..... B05D 3/02

[52] U.S. Cl. ..... 427/358; 427/361; 427/364; 427/365; 427/366; 427/382; 427/391; 427/392; 427/395; 427/396; 162/134; 162/136

[58] Field of Search ..... 162/134, 135, 162/136; 427/358, 361, 364, 365, 366, 379, 391, 392, 393, 395, 396, 397, 382

[56] References Cited

U.S. PATENT DOCUMENTS

| | | | |
|---|---|---|---|
| 4,865,914 | 9/1989 | Malhotra | 428/331 |
| 5,118,533 | 6/1992 | Saji et al. | 427/366 |
| 5,158,806 | 10/1992 | Unger | 427/359 |

FOREIGN PATENT DOCUMENTS

| | | |
|---|---|---|
| 0 496 269 | 7/1992 | European Pat. Off. . |
| 884196 | 3/1989 | Finland . |
| 496775 | 12/1938 | United Kingdom . |
| 1001778 | 8/1965 | United Kingdom . |
| 1030195 | 5/1966 | United Kingdom . |
| 2 262 542 | 6/1993 | United Kingdom . |
| WO 95/28522 | 10/1995 | WIPO . |

OTHER PUBLICATIONS

*Patent for Inventions*, Abridgments of Specifications, Herland Printing Works, York, 1954, Abstract for U.K. Patent No. 623,357, p. 39.

*Patent for Inventions*, Abridgments of specifications, Herlad Printing Works, York, 1954, Abstract for U.K. Patent No. 609,927, pp. 141–142.

Dialog File 351 (World Patents Index) English language abstract of FI 884196, WPI Accession No. 89–087231/12. 1989.

Dahlvik, P., et al., "Interactions in Coating Colors Induced by Temperature–Sensitive Cellulosic Polymer," *Intl. Paper and Coating Chem. Symp.*, Ottawa, Canada, pp. 155–162 (Jun. 1996).

European Search Report for European Application No. EP 98 66 0001 Mar. 1998.

*Primary Examiner*—Erma Cameron

*Attorney, Agent, or Firm*—Sterne Kessler Goldstein & Fox P.L.L.C.

[57] ABSTRACT

The present invention concerns a process and a coating color for coating a cellulosic web. According to the process an aqueous coating color is applied on the surface of the web. The invention comprises using a coating color which contains an aqueous polymer whose viscosity in an aqueous solution increases when the temperature rises. Preferably, methylcellulose or a corresponding polymer having a gelling temperature of about 5 to 10 ° C. more than the application tempature of the coating color is used. The temperature of the coating is increased after the application of the coating color in order to achieve gelling of the polymer. As a result, the coating color rapidly solidifies which decreases the amount of mixture being recycled and it reduces mist-formation in the film press method and improves coverage of coating applied by conventional blade coating.

12 Claims, 1 Drawing Sheet

PROCESS AND COATING COLOR FOR COATING OF PAPER AND BOARD

BACKGROUND OF THE INVENTION

The present invention concerns a process for coating of paper, board and similar cellulosic materials.

According to such a process, an aqueous coating colour is applied to the surface of a web.

1. Field of the Invention

The present invention also concerns a coating colour and the use thereof for coating of paper and board.

Papers and boards are provided with various mineral coatings in order to improve the printability of the products, i.e., to improve the properties of the printing surface and the printing process. The objective of the coating is to cover the fibres and fibrous flocks of the paper or board and thereby decrease the roughness of the surface and the size of the surface pores. The coatings usually consist of pigments and binding agents and various additives.

2. Description of Related Art

It is known in the art to perform coating by applying, in relation to the final coating amount, a manifold amount of coating colour, which is then scraped to the final amount, usually with a blade. The aim is to obtain the best possible coverage and other desired properties with a minimal use of coating colour. A further objective is to perform coating at high speed. One of the problems related to the doctor blade coating technique described above is that a large amount of the mixture has to be recycled.

One of the alternative, new coating methods, is a method known as film press. It is based on transferring the coating colour onto the material to be coated in a nip consisting of two rolls. The coating colour is applied on the roll and some of the applied amount is transferred to the web. The amount that is transferred depends on the properties of the mixture and the base web. The amount that is recycled into circulation is much smaller in the film press method than in other usual coating methods and therefore also smaller changes occur in the mixture with longer application times. The advantages of the film press method include the possibility to obtain a large coat weight area at higher speed than before, and the fact that the coverage of the base web, even with small amounts of coating, is better than with the doctor blade method.

Draining is considered to be the mechanism leading to coating and the formation of the coating structure. Because the pores of the base web, which acts as a filter, are larger than the average particle size of the mixture, it is essential to prevent the infiltration of the mixture components into the web pores, in order to obtain a high coverage. The faster the mixture attains its immobilisation (solidification) point—a state, in which the particles no longer can move in relation to each other—the smaller is the amount of the mixture that infiltrates the pores of the paper. Thereby the mixture covers better the web to be coated. The coverage of the mixture is an essential factor when smaller amounts of coating are desired.

Mist-formation, i.e., the formation of drops of the coating colour when the nip opens, is a problem related to operating the method of film press at high speed. The emitted mixture particles can land on the coated web and also contaminate the coater and its environment. When transferring the mixture applied to the roll in the nip onto the surface of the web to be coated, part of this mixture layer solidifies to a state, in which it no longer splits when the nip is opened. Part of the mixture layer remains unsolidified.

According to recent knowledge, mist-formation depends primarily on the thickness of the unsolidified splitting layer of the mixture and the splitting speed of the film (which depends on, i.a., the operating speed and the diameter of the rolls). When the coating layer sets quickly and the solidified layer is thick, the thickness of the free layer, which is emitted as a result of splitting, remains small. In these circumstances, mist-formation is minimized. Also the amount of coating in the film press method is determined by the total sum of the solidified layer and the mixture layer remaining on the base web in the splitting phase of the unsolidified mixture layer. The fraction of the mixture applied on the roll that is transferred onto the web to be coated is larger; and the amount of mixture recycled is smaller, when using mixtures that solidify quickly and have a low immobilisation point, than when using mixtures that solidify slowly and have a high immobilisation point.

Interaction between the components of the coating will influence the solidification of the coating. The following means are available for speeding up immobilisation of the coating and, thus, for improving the coverage of the coating and, in coating processes based on film press, for decreasing the amount of mist-formation and reducing the amount of the coating in circulation:

1) Removal of water from the mixture by the use of an absorbing base paper and by using a mixture which has poor water retention; rapid removal of water causes rapid solidification of the coating colour;
2) Use of a coating colour which has a high dry matter content at coating so as strongly to increase the viscosity in the nip already at a small increase of the dry matter content;
3) Use of cationic components in an anionic coating mixture.

In the first case, the properties of the circulating mixture are changed constantly during the process (e.g. the dry matter content increases and the binder concentration decreases). At high coating speeds in the film press method, no improvements can be obtained with this method.

The second alternative does not influence the transferred amount of mixture at high coating speeds (over 1200 m/min) in the film press method, but mist-formation is reduced when the dry matter content increases. The increase of the dry matter content of the mixture is limited by the dry matter contents of the components and the interactions between them (viscosity). In the third case, cationic components can be used in anionic paper making processes only to a limited extent.

BRIEF SUMMARY OF THE INVENTION

It is an object of the present invention to remove the problems of the prior art and to provide an entirely novel solution which makes it possible to improve the coverage of coating colours and, further, to avoid the above mentioned problems related to the film press method.

The invention is based on the concept of using a polymer whose viscosity increases when the temperature rises as a thickening agent in the coating colour. This makes it possible to coat a web with a mixture containing the polymer at a lower temperature and at a suitably low viscosity.

The quick immobilisation of the coating should occur before the drying equipment and partly already during the coating when a hot web is coated.

The coating colour according to the invention mainly contains 100 parts of weight of pigments (one pigment or a combination of two or more pigments), 0.1 to 50 parts of weight of at least one binding agent, 0 to 10 parts of weight of others additives, known per se, and 0.1 to 10 parts of weight of a water soluble polymer, which in water forms an aqueous solution, the viscosity which increases when the temperature rises.

More specifically, the process according to the invention is is a process for coating a cellulosic web comprising applying aqueous coating color on the surface of the web to provide a coating layer, wherein said coating color comprises an aqueous polymer; wherein the viscosity of said polymer in an aqueous solution increases when the temperature rises, and increasing the temperature of the coating layer on the web surface immediately after application of coating color to rapidly immobilize the coating color, and drying the cellulosic web.

The coating colour according to the invention is, a coating colour which contains 10 to 100 parts by weight of at least one pigment, 0.1 to 50 parts by weight of at least one binder, and 0 to 10 parts by weight of other additives, known per se, characterized in that it further contains 0.1 to 10 parts by weight of a water-soluble polymer, the viscosity of an aqueous solution of which increases when the temperature is raised.

The use according to the invention wherein said use is use of methylcellulose, hydroxypropyl methylcellulose, hydroxyethyl methylcellulose and hydroxybutyl methylcellulose as a thickening agent in coating colours for paper or board.

Considerable advantages are obtained by means of the invention. For example, the amount of recirculated mixture is smaller, and less mist-formation occurs in the film press method at high speed, as a result of the polymer improving the setting properties of the coating colours. A strong decrease of viscosity following a rise in temperature slows down the solidification when using polymers known per se as thickening agents. Furthermore, the coating colours according to the invention have an excellent coverage.

The invention is particularly suitably to the film press method, whereby the mixture is quickly solidified in the nip, e.g., with a relatively small rise in temperature using a heated back roll (counter roll). The immobilisation of the coating mixture is furthermore also improved as a result of the increase in the dry matter content occuring in the nip.

The invention will be examined in greater detail with the aid of the following detailed description and some working examples.

DETAILED DESCRIPTION OF THE INVENTION

Figure 1:
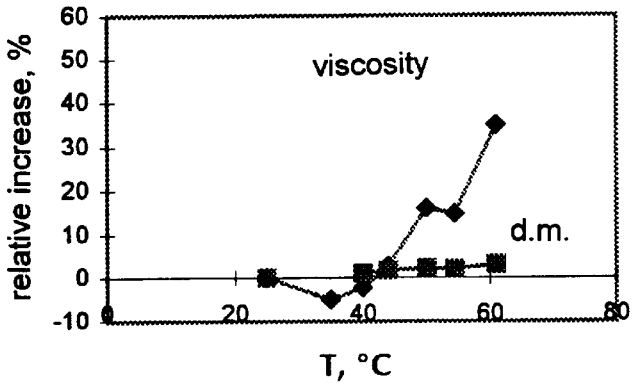
FIG. 1 presents viscosity versus temperature for a coating colour containing low molecular weight methylcellulose.

In the present invention "coating colour" means a composition designed for the coating or surfacing of paper or board, containing water and components known per se, such as pigments, binding agent and a component regulating the viscosity (a thickening agent). Pigments are, e.g., calcium carbonate, calcium sulphate, aluminium silicate, kaolin (aluminium silicate containing cristallization water), aluminium hydroxide, magnesium silicate, talc (magnesium silicate containing cristallization water) titanium oxide and barium sulphate and mixtures of these. Also synthetic pigments may be used. Primary pigments of those mentioned above are kaolin and calcium carbonate, usually amounting to over 50% of the dry matter of the coating composition. Calcinated kaolin, titanium oxide, precipitated carbonate, satin white, aluminium hydroxide, sodium silica aluminate and plastic pigments are additional pigments and the amounts of these are usually below 25% of the dry matter content of the mixture. Special pigments to be mentioned are special kaolins and calcium carbonates and barium sulphate and zinc oxide.

Any binding agent know per se, which is frequently used for manufacturing paper, can be used as a binder. In addition to individual binders it is also possible to use mixtures of binding agents. As specific examples of typical binding agents the following can be mentioned: synthetic latex-type binders consisting of polymers or copolymers of ethyleneically unsaturated compounds, such as butadiene-styrene type copolymers which can contain a comonomer with a carboxylic group, such as acrylic acid, itaconic acid or maleic acid, and poly(vinyl acetate) which contains comonomers having carboxylic groups. In combination with the afore-mentioned substances e.g. water-soluble polymers, starch, CMC, hydroxy ethyl cellulose and poly(vinyl alcohol) can be used as binders.

In the coating mixture there can further be used conventional additives and adjuvants, such as dispersing agents (e.g. sodium salt of poly(acrylic acid)), substances for adjusting the viscosity and water rentention of the mixture (e.g. CMC, hydroxyethyl cellulose, polyacrylates, alginates, benzoate), lubricating agents, hardeners for improving the water resistance, optical agents, anti-foaming agents and substances for regulating the pH and for preventing product degradation. The lubricating agents include sulphonated oils, esters, amines, calcium and ammonium stearates; the agents improving water resistance include glyoxal; optical agents include diaminostilben and derivatives of disulphonic acid; the anti-foaming agents include phosphate esters, silicones, alcohols, ethers, vegetable oils, the pH-regulators include sodium hydroxide and ammonia; and, finally, the anti-degradation agents include formaldehyde, phenol and quaternary ammonium salts.

The term "cellulosic material" denotes paper or board or a corresponding cellulose-containing material, which is derived from a lignocellulosic raw material, in particular from wood or from annual or perennial plants. Said material can be wood-containing or wood-free and it can be produced from mechanical, semi-mechanical (chemi-mechanical) or chemical pulp. The pulp can be bleached or unbleached. The material can also contain recycled fibers, in particular reclaimed paper or reclaimed board. Typically, the grammage of the material web lies in the range of 50 to 250 g/m$^2$.

The coating compositions according to the present invention can be used both as pre-coat mixtures and as surface coating colours. For 100 parts by weight of pigment the coating colour typically contains about 0.1 to 10 parts by weight of the thickening agent and 1 to 20 parts by weight of a binder.

The composition of a typical pre-coat mixture is the following:

| | |
|---|---|
| pigment/filler (e.g. coarse calcium carbonate) | 100 parts by weight |
| thickener | 0.1 to 2.0 parts by weight |
| binder | 1 to 20 parts by weight |
| additives | 0.1 to 10 parts by weight |
| water | balance |

The dry matter content of a pre-coat mix is typically 40 to 70% and the pH 7.5 to 9.

In the coating colours according to the invention 1 to 100 wt-%, preferably about 75 to 100 wt-% of the thickener consists of a polymer whose viscosity increases when the temperature rises (cf. the detailed description below). The rest of the thickening agent consists of substances known per se, such as carboxymethylcellulose.

The composition of a surface coating colour according to the present invention is, for example, the following:

| | |
|---|---|
| pigment/filler I (e.g. fine calcium carbonate) | 30 to 90 parts by weight |
| pigment/filler II (e.g. fine kaolin) | 10 to 30 parts by weight |
| total pigment | 100 parts by weight |
| thickener | 0.1 to 2.0 parts by weight |
| binder | 1 to 20 parts by weight |
| additives | 0.1 to 10 parts by weight |
| water | balance |

The dry matter content of a coating colour is typically 50 to 75%.

In the above-mentioned coating colour at least a part (1 to 100%, preferably about 20 –100 %) of the finely-divided calcium carbonate can be replaced by precipitated calcium carbonate (PCC).

In the process according to the present invention, the thickening agent used comprises a polymer or a polymer mixture containing one or several polymer(s) together with additives, if any. A substantial part of the thickening agent comprises a polymer which is water-soluble and whose viscosity changes depending on the temperature. It is particularly preferred to use a polymer which forms an aqueous solution whose viscosity strongly increases when the temperature rises over a relatively small temperature interval. Polymers of this kind are, e.g., methylcellulose (MC) and ether derivatives thereof, such as hydroxy alkyl ethers, such as hydroxypropyl methylcellulose (HPMC), hydroxyethyl methylcellulose (HEMC) and hydroxybutyl methylcellulose (HBMC). These substances are commercially available and supplied for example by the trade names Methocel (Methocel A, Methocel E, F, J, K and 310 series; supplier The Dow Chemical Co.) and Marpolose (supplier Matsumot Yushi Seiyaku Co. Ltd.).

The viscosity of methylcellulose and the above ethers thereof decreases first when the temperature rises up to a certain temperature. Then the viscosity strongly increases. The temperature at which the viscosity growth commences is called the gelling temperature. According to the present invention, the process is carried by increasing the temperature of the web after the application of the coating colour in order to achieve gelling of the polymer which simultaneously provide stiffening and solidification of the coating colour.

Typically, at the gelling temperature the viscosity of the polymer increase by at least 10%, preferably about 30 to 50%. The vicosity of a coating mixture according to the invention grows over the temperature range from room temperature to about 60 to 70° C. clearly more than can be accounted for by the increase of the dry matter content due to evaporation of water and liquid. Preferably the viscosity of the coating colour increases by at least 10%, preferably at least 20% and in particular about 25 to 50% in the temperature range from 25 to 60° C.

The gelling temperature is not dependent on the viscosity class of the product (the degree of polymerization to molecular size-ratio). Instead, the rate of the temperature increase, the shear forces and the additives influence the gelling temperature. Salts lower the gelling tempeature depending on the salt concentration and the cationic and anionic charge. The gelling temperature can also be increased by using short-chained alcohols and glycols, which thus can be included in the thickening agent used as a component of the coating mixture.

The strength of the three-dimensional structure formed by the gel increases when the concentration of the methylcellulose and its viscosity (viscosity class) grows. Gelling is reversibel, this means that when the temperature drops below the gelling temperature, the viscosity decreases again. Certain electrolytes can compete with the methyl celluloses for water and cause precipitation.

The rheology of the methylcelluloses below the gelling temperature is pseudoplastic and it approaches the Newtonian at low shear rates. The pseudoplastic character increase when the concentration of the polymer and the molar mass grow. At small molar masses the Newtonian behaviour prevails over a rather broad range of shear forces. This kind of rheological behaviour does not cause any problems in the earlier steps of the process.

According to "Encyclopedia of Polymer Science and Engineering, Vo. 3, p. 252", the gelling temperatures of pure products in aqueous solutions are the following:

| | |
|---|---|
| MC | 48° C. |
| HPMC | 54–77 ° C. |
| HBMC | 49 ° C. |

Furthermore, the amounts of the substituents employed during the preparation of the cellulose ethers have an influence on the gelling temperature (Encyclopedia of Chemical Technology, Kirk-Othmer, Vol. 5, p. 150) and it can be adjusted to a value in the range of 45 to 90° C. An example of the influence of the substituents on the gelling temperatures of cellulose ethers, the gelling temperatures of the following commercial (Marpolose) products are disclosed; the first grade is an MC and the two last ones are HPMC's (Matsumoto Yushi Seiyaku Co Ltd.).

TABLE 1

Gelling temperatures of substituted cellulose ethers

| | methoxyl content, % | hydroxypropoxyl content, % | gelling temperature/ precipitation temperature, ° C. |
|---|---|---|---|
| M grades | 27–32 | — | 50–55 |
| 65 MP | 27–29 | 4–7.5 | 60–65 |
| 90 MP | 19–24 | 4–12 | 85–90 |

In the machine circulation, the temperatures used for the process according to the present invention are usually 40 to 60° C. The polymer and its viscosity class are preferably selected to that a relatively small increase of temperature is enough to achive stiffening and immobilisation of the mixture. The viscosity before the temperature chock should not be too high. Further, some fine tuning of the gelling temperatures can, if necessary, be carried out by using the above mentioned additives.

The process according to the invention for coating paper and/or board can be carried out on-line or off-line by using conventional coaters, including for example doctor blade coaters and air brush coaters. In order to provide rapid immobilisation of the coating colour coated onto the paper web it is preferred to have heaters, such as heating radiators (e.g. IR radiators) arranged close to the application means. It is preferred to heat up the coating before the actual drying of the paper, as conventionally performed in the art today. However, it is conceivable that the drying equipment can be modified so as to provide for a combination of the heaters used in the present invention with the heaters of the drying section e.g. by arranging the latter heaters closer to the coater. Thus, the step according to the present invention of increasing the temperature of the coating after the coating can be performed as an integral part of the drying. The crucial point is to increase the temperature of the coating layer (preferably up to the gelling temperature) immediately after coating. Depending on machine speed this means a distance of, for example, about less than 150 cm, preferably less than 100 cm and in particular less than 70 cm, from the coater. The heating energy applied to the coating for increasing the temperature thereof can be less than for drying the coating. Preferably the temperature is increased throughout the whole layer which conventionally has a thickness of about 10 to 50 $\mu$m, typically about 15–25 $\mu$m.

The invention is particularly suitable to film coating, in which case a conventional coater construction intended for film coating can be modified preferably by providing the (web-supporting) back roll with heating means for increasing the surface temperature thereof to the desired range. During film press coating, the temperature is thus increased already in the coating nip. A soft back roll can also be used, if necessary, for providing a longer roll nip. In particular during on-line coating the base paper is warm already when it comes to coating which makes the warming up of the mixture more rapid and aids in the settling thereof. If necessary, the web can also be separately heated before coating.

Depending on the suitable coating temperature of the process, the polymer is selected so that its gelling temperature is normally at least a couple of degrees (2 to 3° C.), preferably about 5 to 10° C. higher than said temperature. Further the viscosity class of the polymer and its concentration are selected so as to provide a coating colour of suitable viscosity before coating. This makes it possible to reduce the employed amounts of other thickeners, such as carboxymethylcellulose, or to replace them altogether. The temperature of the back roll and the base paper is adjusted depending on the paper and its grammage and on the machine velocity so that the temperature of the web after the roll nip is sufficient to achieve gelling of the polymer. Generally, a temperature rise of 3 to 10° C. is sufficient. If there are temperature variation in the machine circulation, a larger reliability marginal between the temperature of the circulation and the gelling temperature can be chosen.

The following non-limiting examples illustrate the invention:

EXAMPLE 1

Determination of the solidification point and the solidification rate

This Example discloses how the viscosity of the coating colour used in the present invention changes when the temperature is increased in comparison to a conventional coating colour in which carboxymethyl cellulose is used as a thickening agent.

For this test a number of solutions were prepared from methyl celluloses of different viscosity classes. The dry matter contents of the solutions were 3.4%. The solutions were prepared by a procedure known as the hot/cold method, which comprises initially dispersing MC (methyl cellulose) in hot water (90° C.) having a volume of two thirds of the final volume. After dispersion ice and cold water was added to the solution to make up the final volume and for lowering the temperature. When the temperature of the mixture dropped, MC dissolved and then also the viscosity increased.

In addition to a reference, two coating colours to be studied were prepared. The viscosity of all coating colours was about 1,500 mPas (using a Brookfield Viscometer at a spindle speed of 100 rpm). The MC grades used in the coating colours were of different viscosity classes. The molar massa of the grade A4C-MC was 41,000, its viscosity in a 2% solution being about 400 cP. The molar mass of the grade A4M-MC was, again, 86,000 and its viscosity at the corresponding conditions about 4,000 cP. Both were cellulose ethers supplied by The Dow Chemical Company and marketed under the trade name Methocel.

The pigments used in the test were ground calcium carbonate (HC-90, supplier: Suomen Karbonaatti Oy) and kaolin (AMAZON, supplier Kaolin International BV) and the binder a styrene butadiene latex (DL 925, supplier: Dow Latex). In the reference test CMC was used. The CMC was supplied under the trade name FF-10 (supplier: Metsa Specialty Chemicals Oy).

The viscosity of the coating colour was adjusted the the predetermined value by using a suitable amount of MC (the suitable amount was experimentally determined by adding different amounts of premade MC-solution). The composition and the addition order of the components of the coating colours is presented in the following tables (the substances are added in the same order as they are presented).

TABLE 2

| | | Reference | | |
|---|---|---|---|---|
| Substance | Parts | Dry amount, g | Dry matter content, % | Wet amount, g |
| HC-90 (ground $CaCO_3$) | 70 | 350 | 74.5 | 470 |
| AMAZON 88 (kaolin) | 30 | 150 | 73.5 | 205 |
| FF-10 (CMC) | 0.55 | 2.8 | 12.0 | 23 |
| DL 925 (styrene butadiene) | 12 | 60 | 50.0 | 120 |

TABLE 3

| The coating colour prepared from methylcellulose of small molar mass | | | | |
|---|---|---|---|---|
| Substance | Parts | Dry amount, g | Dry matter content, % | Wet amount, g |
| HC-90 (ground $CaCO_3$) | 70 | 350 | 75.0 | 468 |
| AMAZON 88 (kaolin) | 30 | 150 | 73.0 | 205 |
| MC A4C (methylcellulose) | 0.4 | 1.9 | 3.5 | 56 |
| DL-925 (styrene butadiene latex) | 12 | 60 | 50.0 | 120 |

TABLE 4

| Coating colour prepared from methylcellulose of large molar mass | | | | |
|---|---|---|---|---|
| Substance | Parts | Dry amount, g | Dry matter content, % | Wet amount, g |
| HC-90 (ground $CaCO_3$) | 70 | 350 | 75.0 | 468 |
| AMAZON 88 kaolin) | 30 | 150 | 73.0 | 205 |
| MC-A4M (methyl cellulose) | 0.25 | 1.25 | 3.0 | 37 |
| DL-925 (styrene butadiene latex) | 12 | 60 | 50.0 | 120 |

The coating colours were heated (light mixing) and the Brookfield viscosities were measured at different temperatures. The containers were covered to prevent evaporation and, thus, a change of the dry matter content.

Figure 2:
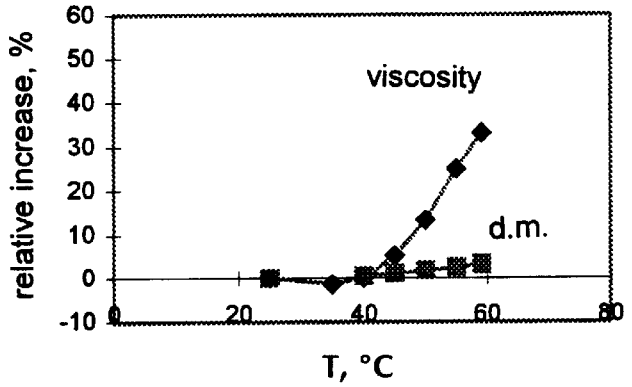
FIG. 2 presents viscosity versus temperature for a coating colour high molecular weight methylcellulose.
Figure 3:
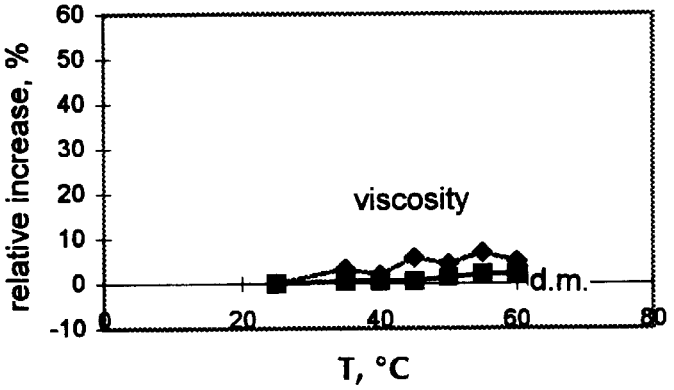
FIG. 3 presents viscosity versus temperature for the (reference) coating colour containing carboxymethyl cellulose.

The results are given in tables 5 to 7. The corresponding graphical presentation are given in FIGS. 1 to 3; FIG. 1 corresponds to Table 5, FIG. 2 to Table 6 and FIG. 3 to Table 7:

TABLE 5

| Methylcellulose (M = 41,000, visc. class in a 2% solution = 400 cP) | | |
|---|---|---|
| ° C. | Br 100 Viscosity | Dry matter content, % |
| 25 | 1455 | 64.6 |
| 35 | 1380 | |
| 40 | 1420 | 65.3 |
| 45 | 1495 | 65.8 |
| 50 | 1690 | 66.0 |
| 55 | 1670 | 65.9 |
| 60 | 1960 | 66.6 |

TABLE 6

| Methylcellulose (M = 86,000, visc. class in a 2% solution = 4,000 cP) | | |
|---|---|---|
| $T_1$ ° C. | Br 100 Viscosity | Dry matter content, % |
| 25 | 1480 | 64.9 |
| 35 | 1460 | |
| 40 | 1480 | 65.3 |
| 45 | 1555 | 65.6 |
| 50 | 1675 | 66.0 |

TABLE 6-continued

| Methylcellulose (M = 86,000, visc. class in a 2% solution = 4,000 cP) | | |
|---|---|---|
| $T_1$ ° C. | Br 100 Viscosity | Dry matter content, % |
| 55 | 1850 | 66.5 |
| 60 | 1970 | 67.0 |

TABLE 7

| CMC reference | | |
|---|---|---|
| CMC | Br 100 | Dry matter content, % |
| 25 | 1440 | 65.0 |
| 35 | 1490 | 65.3 |
| 40 | 1470 | 65.3 |
| 45 | 1525 | 65.3 |
| 50 | 1505 | 65.9 |
| 55 | 1540 | 66.3 |
| 60 | 1510 | 66.3 |

Although the containers were covered, some evaporation took place, which caused a minor increase of the dry matter content. In spite of this, when examining the attached drawings depicting the relative increases in viscosity and dry matter content as a function of the temperature, it is readily seen that the increase in viscosity is substantially greater when MC is used than for CMC. More precisely, the viscosity increase for MC is almost 35% in the temperature range of 25 to 60° C., whereas the increase in viscosity for CMC caused by growing dry matter content was less than 5%.

EXAMPLE 2

The function of the polymer in coating The coating colours disclosed in Example 1 are used for coating of a paper web in a Heli-coater laboratory coater (blade coater). The coater was provided with an infrared radiator for increasing the temperature of the coating colour immediately after application of coating colour on the web.

The paper web comprises a woodfree paper having a surface weight of 60 g/m$^2$, and 10 g/m$^2$ of the coating colour is applied on it. The web which is to be coated is heated and the temperature of the coating layer applied to web is rapidly increased over the gelling temperature by using the IR radiator. The velocity is 900 m/min and the coating colour is also warm (45° C.).

It can be found that the coating is quickly dried leaving a uniform and even coating surface. The immobilisation is rapid due to gelling, whereby the coating provides good coverage.

What is claimed is:

1. A process for coating a cellulosic web comprising applying a coating color in an aqueous solution on the surface of a cellulosic web to provide a coating layer, wherein said coating color comprises a water soluble polymer; the viscosity of which increases when the temperature rises, increasing the temperature of said coating layer on the surface of said web immediately after application of said coating color to rapidly immobilize said coating color on said cellulosic web to form a coated cellulosic web, before drying said coated cellulosic web.

2. The process of claim 1, wherein said coating color comprises a polymer having a gelling temperature of at least 2 to 3° C. higher than the temperature of the coating process.

3. The process of claim 2, wherein the polymer comprises methylcellulose or its ether derivative.

4. The process of claim 3, wherein the ether derivative of methylcellulose comprises hydroxy propylmethyl cellulose, hydroxy ethyl methylcellulose or hydroxy butyl methylcellulose.

5. The process of claim 2 wherein the gelling temperature of said polymer is adjusted by addition of additives.

6. The process of claim 1, wherein the polymer comprises a mixture comprising methylcellulose and wherein said mixture has a gelling temperature adjusted by the degree of substitution of the methylcellulose.

7. The process of claim 1 wherein coating is carried out by the film press method.

8. The process of claim 7, wherein the temperature of the web is increased after the application of the coating color by heating the web with a heated back roller.

9. The process of claim 8, wherein the web is heated prior to coating.

10. The process of claim 1, wherein the coating is blade coating.

11. The process of claim 10, wherein the coated web is heated immediately after the coating with heating radiators.

12. A process for coating a cellulosic web comprising applying an aqueous coating colour comprising methyl cellulose or an ether derivative thereof to the surface of a cellulosic web to form a coating;

increasing the temperature of said coating immediately after the application of said coating color to immobilize said methylcellulose or ether derivative thereof to form a coated cellulosic web, before drying said coated cellulosic web.

* * * * *